US006443320B1

(12) United States Patent
Herzog et al.

(10) Patent No.: US 6,443,320 B1
(45) Date of Patent: Sep. 3, 2002

(54) STORAGE RACK SYSTEM AND LOCKING LATCH THEREFOR

(75) Inventors: Richard R. Herzog, Arlington Heights; Terrence P. Meier, Naperville, both of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/693,045

(22) Filed: Oct. 20, 2000

Related U.S. Application Data

(63) Continuation of application No. 09/300,923, filed on Apr. 28, 1999, now abandoned.

(51) Int. Cl.[7] ..... A47B 47/00
(52) U.S. Cl. ..... 211/192; 248/222.11
(58) Field of Search ..... 211/192; 403/315, 403/316, 319; 292/87; D8/331; 248/221.11, 222.11

(56) References Cited

U.S. PATENT DOCUMENTS 3,392,848 A * 7/1968 McConnell et al. ..... 211/192
3,741,405 A 6/1973 McConnell et al.
3,905,712 A 9/1975 McConnell
5,025,937 A * 6/1991 King ..... 211/192
5,350,074 A * 9/1994 Rosenband ..... 211/192
6,230,910 B1 * 5/2001 Olsson et al. ..... 211/192
6,241,109 B1 6/2001 Kautz et al. ..... 211/192

* cited by examiner

*Primary Examiner*—Daniel P. Stodola
*Assistant Examiner*—Erica B Harris
(74) *Attorney, Agent, or Firm*—Paul F. Donovan; Mark W. Croll; Donald J. Breh

(57) ABSTRACT

A storage rack system, locking latch therefor, and combinations thereof. The latch having generally a flexible and resilient arm coupleable to a beam member and having a locking pin coupled thereto. The resilient arm biases the locking pin through a locking pin opening of the beam member so that the locking pin protrudes at least partially into a post opening aligned at least partially with the locking pin opening when the beam member is connected to the post by a headed lug. A locking flange extending generally radially from the locking pin is engageable with a portion of the beam member to inhibit withdrawal of the locking pin from the locking pin opening.

22 Claims, 4 Drawing Sheets

STORAGE RACK SYSTEM AND LOCKING LATCH THEREFOR

CROSS REFERENCE TO RELATED APPLICATIONS

The present application is a continuation application of commonly assigned U.S. application Ser. No. 09/300,923 filed on Apr. 28, 1999, also entitled "Storage Rack System And Locking Latch Therefor", now abandoned, from which priority under 35 U.S.C. §120 is hereby claimed.

BACKGROUND OF THE INVENTION

The invention relates generally to storage rack systems, and more particularly to storage rack systems having beam members connected to posts with interconnecting headed lugs, and locking latches therefor.

Storage rack systems comprising vertical posts for supporting horizontal beam members are known generally and used widely. It is also known generally to assemble the beam members to the posts, without the use of nuts and bolts or any special tools, by disposing one or more connecting headed lugs protruding from flanges on the horizontal beam members in corresponding openings on the posts in an interlocking manner.

U.S. Pat. No. 3,741,405 entitled "LoadLock", for example, discloses a pallet rack comprising vertical posts having slanted key hole shaped slots into which headed lugs protruding from horizontal beam members are disposed and retained to interconnect the beam members to the posts. U.S. Pat. No. 3,741,405 also discloses locking bolts slidable to protrude from end portions of the beam members and into corresponding openings in the posts to lock the beam members thereto. Additional labor is required however to slide and engage the locking bolt with the post, and in some cases a hammer blow to the bolt may be necessary to ensure proper locking engagement with the post. In these prior art systems, many beam members are connected to the posts by the headed lugs only, without the benefit of the locking bolt, which is necessary to prevent lifting of the beam member relative to the post and inadvertent separation thereof, for example by an inattentive fork lift operator.

U.S. Pat. No. 3,905,712 entitled "Snap Lock for Quickly-Detachable Beam-To-Post Joint" discloses vertical posts having generally clover-leaf shaped openings, or quad-holes, for interlockingly accommodating headed lugs protruding from horizontal beam members. U.S. Pat. No. 3,905,712 also discloses a snap lock device for locking the beam members to the posts. The snap lock device comprises generally a locking pin fastened to a resilient arm coupled to a flange of the beam member. The locking pin is biased by the resilient arm to protrude through an opening of the flange and into a corresponding opening on the post aligned therewith. The locking pin may be withdrawn from the opening of the post by flexing the resilient arm, thereby permitting disassembly of the posts and beam members. The resilient arm however may be easily over-flexed beyond its elastic limit to an extent that it loses its resiliency and thus its ability to bias the locking pin into engagement with the post.

The present invention is drawn toward advancements in the art of locking latches, sometimes referred to herein merely as latches, for lockingly interconnecting upstanding posts and horizontal beam members, and combinations thereof.

An object of the invention is to provide novel storage rack systems, locking latches therefor, and combinations thereof that overcome problems in the art.

Another object of the invention is to provide novel storage rack systems, locking latches therefor, and combinations thereof that are economical.

Another object of the invention is to provide novel storage rack systems, latches therefor, and combinations thereof that are relatively easy to manufacture and assemble.

A further object of the invention is to provide novel storage rack systems, latches therefor, and combinations thereof that are durable and reliable.

Another object of the invention is to provide novel storage rack systems having universal beam flanges with symmetric locking pin openings for accommodating a locking latch, whereby the universal beam flanges may be disposed on either opposing end portion of a beam member during manufacture thereof.

Another object of the invention is to provide novel latches for storage rack systems that permit handling a beam member of the storage rack system when the locking latch is fastened to a beam flange on an end portion thereof.

Yet another object of the invention is to provide novel latches that automatically lock beam members to posts when the beam members are connected thereto by headed lugs, without additional labor or consideration by the installer for installation of the locking latch.

Another object of the invention is to provide novel storage rack system latches that form a gap between the latch and a beam flange when the latch is fastened thereto.

A further object of the invention is to provide novel locking latches having a flexible resilient arm that biases a locking pin through a locking pin opening of a beam member and into a post opening to lock the beam member thereto, whereby the latch is not subject to excessive flexing that may potentially cause damage thereto.

A more particular object of the invention is to provide novel locking latches having a flexible resilient arm that biases a locking pin with a locking flange through a locking pin opening of a beam member and into an opening of a post to lock the beam member to the post, whereby withdrawal of the locking pin from the locking pin opening is inhibited by the locking flange upon engagement thereof with a beam flange of the beam member.

Another more particular object of the invention is to provide novel storage rack systems comprising generally a beam member connectable to a post by a headed lug, and a locking latch having a resilient arm fastened to the beam member. The resilient arm biases a locking pin extending therefrom through a locking pin opening of the beam member so that the locking pin protrudes at least partially into a post opening aligned therewith when the beam member is connected to the post by the headed lug. A locking flange extending from one or more sides of the locking pin is engageable with the beam member to inhibit withdrawal of the locking pin from the locking pin opening of the beam member.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
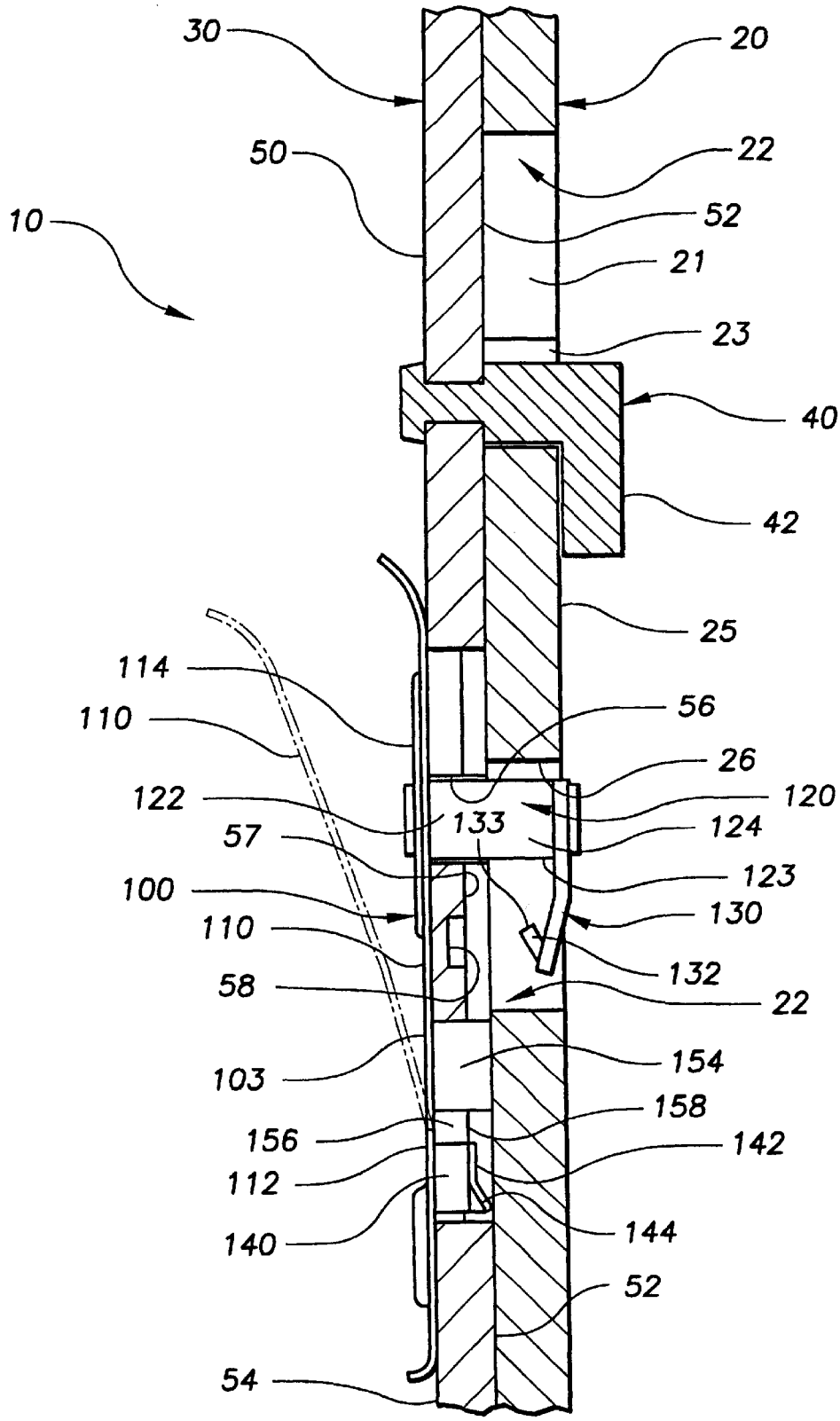
FIG. 1 is a partial sectional view of a storage rack system including a locking latch according to an exemplary embodiment of the present invention.

FIG. 1 is a partial sectional view of a storage rack system 10 comprising generally a post 20 supporting a beam member 30 connected thereto by one or more headed lugs 40 protruding from the beam member 30, and more particularly from a beam flange 50 thereof, and extending into corresponding openings 22 of the post 20.

The headed lugs 40 are coupled to the beam flange 50 by known fastening means, and extend from an inner side 52 of the beam flange 50 for connection with corresponding openings 22 of the post 20. In the exemplary embodiment of FIG. 2, the beam flange 50 is coupled to anend portion 32 of the beam member 30 by aweld 33. Alternatively, the beam flange 50 may be fastened to the beam member 30 by other means, for example by nut and bolt assemblies or by rivets or by other known fastening means, or the beam flange may be formed unitarily with the beam member. There is generally a beam flange on both opposing ends of the beam member as is known generally.

In the exemplary embodiment of FIG. 1, the headed lugs 40 include an enlarged head in the form of a lug flange 42 that extends generally radially from only one side portion thereof for engagement with the post 20, and more particularly for engagement with an inner side 25 of the post 20 to connect the beam member 30 thereto, as discussed further below. With this exemplary arrangement, the beam member 30 is coupled to the post 20 with the lug flanges 42 thereof directed downwardly.

In other embodiments, the enlarged heads of the lugs 40 have other shapes, for example the headed lugs may have a generally annular portion that extends radially from all sides of the lug 40 as is known generally and disclosed in the referenced U.S. Pat. No. 3,905,712 entitled "Snap Lock For Quickly-Detachable Beam-To-Post Joint". An enlarged head having an annular shape extending radially from all sides of the lug is a more universal configuration that permits inverting the orientation of the beam member 30 when mounting to the posts 20, as is known generally, and may be more desirable for some applications.

Figure 2:
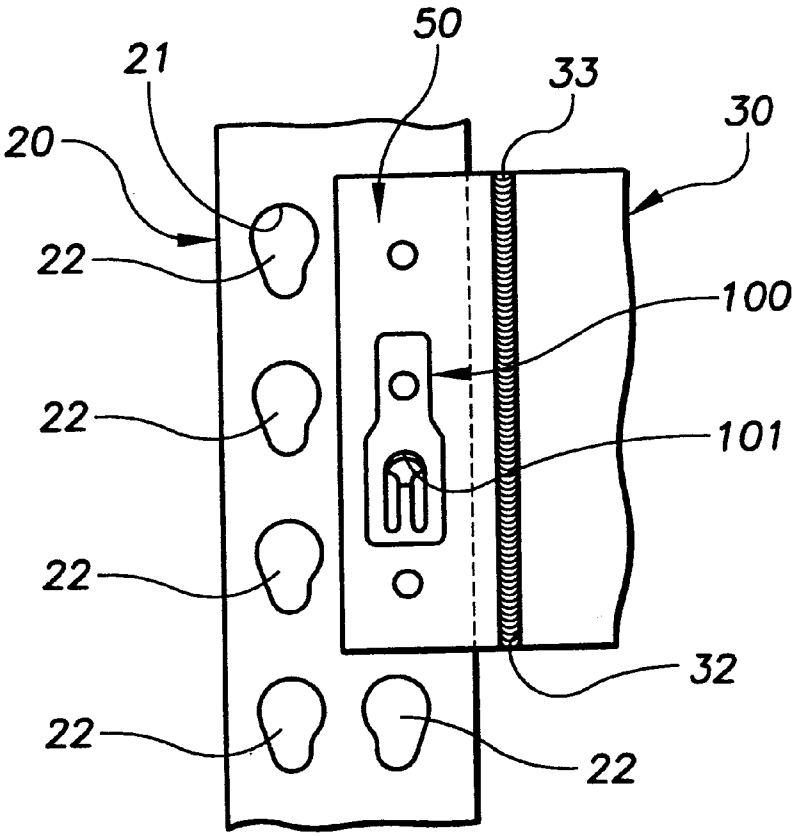
FIG. 2 is a partial view of a post connected to a beam member.

FIG. 2 illustrates the post 20 having the plurality of openings 22 arranged generally in a row thereon for accommodating one or more headed lugs protruding from the beam member 30, whereby the beam member may be adjustably connected to the post as is known. In FIG. 1, the post openings 22 have generally an enlarged upper portion 21 that permits passage of the enlarged head of the lug, and a smaller lower portion 23 that supports the lug but prevents passage of the enlarged head. In exemplary embodiment of FIG. 2, the post openings 22 are generally slanted keyhole type openings, but the post openings 22 may have other alternative shapes, for example the quad-hole shapes disclosed in the referenced U.S. Pat. No. 3,905,712, among other shapes suitable for connecting lugs thereto, as is known.

To assemble the beam member 30 with the post 20 as in FIG. 1, the enlarged head, or lug flange 42, of the lug 40 is disposed through the enlarged upper portion 21 of the post opening 22, whereupon the beam member 30 is lowered slightly relative to the post 20 to position, or seat, the lug 40 in the smaller lower portion 23 of the post opening 22. The lug flange 42 is too large to pass through the smaller lower portion 23 of the post opening 22 and is engageable with the inner side 25 of the post 20. The one or more lugs 40 protruding from the beam member 30 are generally supported by the post 20, and the enlarged heads prevent the lugs 40 from being withdrawn from the post opening 22, unless the beam member 30 is raised relative to the post 20, as is known generally.

Figure 3:
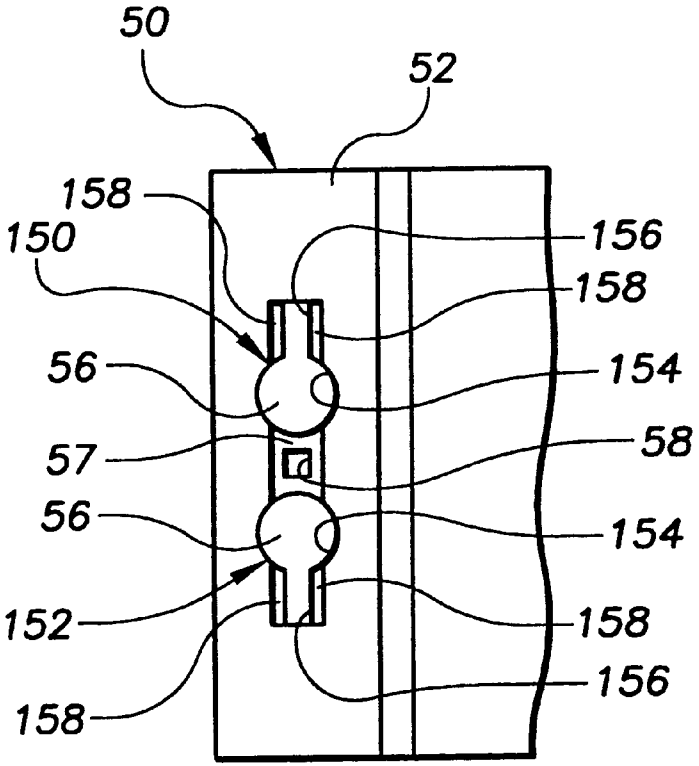
FIG. 3 is a partial view of the beam flange of FIG. 1 on an end of a beam member.

In FIG. 1, the beam flange 50 has a locking pin opening 56 aligned at least partially with one of the plurality of openings 22 of the post 20 when the beam member 30 is connected thereto. FIG. 3 illustrates the beam flange 50 having two locking pin openings 56 corresponding to openings 150 and 152 thereof, either one of which may accommodate the locking pin 120, as discussed further below.

In FIG. 1, a latch 100 is coupled to the beam flange 50 for locking the beam member 30 to the post 20. The latch 100 comprises generally a flexible resilient arm 110 having a locking pin 120 coupled thereto. A first end portion 112 of the resilient arm 110 is coupled, or fastened, to the beam flange 50 and more particularly to an outer side 54 thereof, as discussed more fully below. The locking pin 120 includes generally an end portion extending from the resilient arm 110, and in the exemplary embodiment a first end portion 122 is coupled generally to a second end portion 114 of the resilient arm 110 so that a second end portion 124 of the locking pin 120 is disposed, or extends, away from the first end portion 122 thereof and away from the resilient arm 110.

The resilient arm 110 generally biases the locking pin 120 to protrude through the locking pin opening 56 of the beam flange 50 and at least partially into an opening 22 of the post 20 aligned at least partially with the locking pin opening 56 when the beam member 30 is connected to the post 20. Thus assembled, the locking pin 120 is engageable with a portion or surface 26 of the upper portion 21 of the post opening 22 into which it protrudes to prevent the beam member 30 from being raised or lifted relative to the post, as is otherwise required to align and withdraw the enlarged head 42 of the lug 40 through the enlarged upper portion 21 of the post opening 22. The locking pin 120 thereby locks the beam member 30 to the post 20. FIG. 1 also illustrates partially and in phantom lines the resilient arm 110 flexible away from the outer side 54 of the beam flange 50 to a limited extent for assembly and withdrawal of the locking pin 120 relative to the locking pin opening 56 of the beam flange 50, as discussed below.

In FIG. 1, a locking flange 130 is coupled to the second end portion 124 of the locking pin 120 and extends generally radially therefrom. When the beam member 30 is connected to the post 20, as discussed above, the locking flange 130 extends generally adjacent the inner side 52 of the beam flange 50 and is engageable therewith to inhibit withdrawal of the locking pin 120 from the locking pin opening 56, thereby securing the locking pin 120 in the post opening 22 aligned with the locking pin opening 56 of the beam flange 50. The locking flange 130 also limits flexing of the resilient arm 110 thereby preventing over-flexing thereof to an extent that may cause damage thereto Damage to the resilient arm from over-flexing thereof may prevent proper biasing of the locking pin 120 into the locking pin opening 56 of the beam flange 50, as is problematic with prior art latches.

Figure 4:
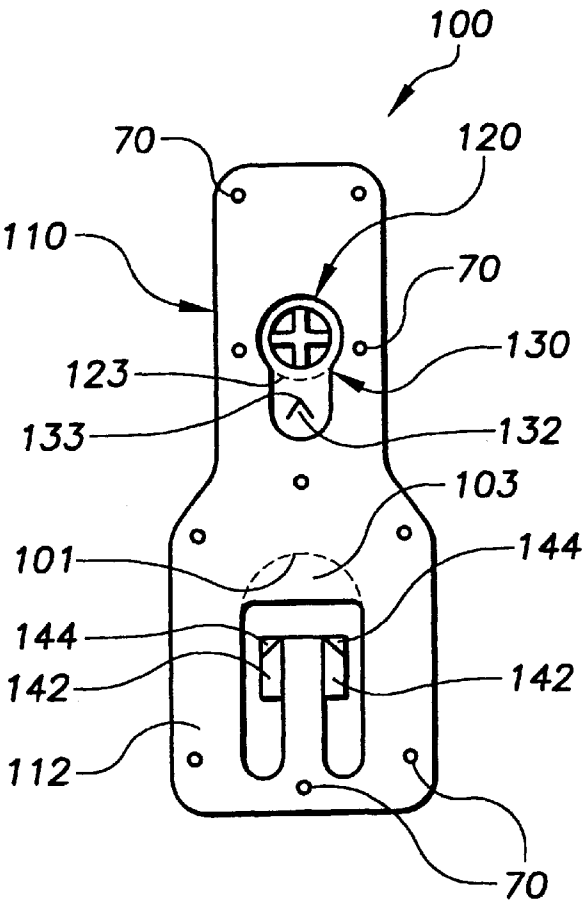
FIG. 4 is a bottom view of the latch of FIG. 1.

In the exemplary embodiment of FIGS. 1 and 4, the locking flange 130 is a single lobe extending generally radially from a side portion 123 of the locking pin 120, although in other embodiments the locking flange may have other configurations for engaging the inner side 52 of the beam flange 50. FIG. 1 also illustrates the enlarged lug flange 42 extending generally radially from a side portion of the lug 40, as discussed above, whereby the lug flange 42 and the locking flange 130 extend generally in the same direction. The one or more lugs 40 and the locking pin 120 protruding through the locking pin opening 56 of the beam flange 50 are generally arranged in a row and are spaced apart in registry with corresponding openings 22 of the post 20 for connection thereto so that the locking pin is engageable with existing post openings.

In FIGS. 1 and 3, the beam flange 50 includes on the inner side 52 thereof a flange recess 57 for accommodating the locking flange 130 of the latch 100 when the resilient arm 110 is flexed outwardly away from the beam flange to permit assembly of the beam member 30 to the post 20, as discussed more fully below. The flange recess 57 is sized to accommodate the locking flange 130 and also to permit positioning of the locking pin 120 through the locking pin opening 56 of the beam flange 50 so that the second end portion 124 thereof does not interfere with the assembly of the beam member 30 and the post 20. In other words, the flange recess 57 is sufficiently deep so that the second end portion 124 of the locking pin 120 and the locking flange 130 do not protrude so far beyond the inner side 52 of the beam flange 50 as to prevent assembly of the beam member 30 with the post 20. The locking flange 130 is engageable with the flange recess 57 to inhibit withdrawal of the locking pin 120 from the locking pin opening 56 upon outwardly flexing the resilient arm 110 away from the beam flange 50, as discussed generally above.

During assembly of the beam member 30 with the post 20, the resilient arm 110 is flexed initially away from the outer side 54 of the beam flange 50 by engagement of the locking pin 120 with the post 20 as the one or more lug flanges 42 are disposed in the enlarged upper portions 21 of corresponding post openings 22. The locking flange 130 is thus disposed in the flange recess 57 of the beam flange when the resilient arm 110 is flexed outwardly away therefrom to permit insertion of the headed lugs into corresponding post openings, as discussed generally above. As the beam member 30 is subsequently lowered relative to the post 20 to seat the lugs in the lower portion of the corresponding post openings, the locking pin 120 is positioned eventually in alignment with another post opening 22 whereupon the resilient arm 110 biases the locking pin 120 into the post opening 22 aligned therewith to lockingly connect the beam member 30 to the post 20, thereby preventing raising the beam member 30 relative to the post 20 as discussed above.

The latch 100 of the present invention is thus self assembled with the post 20 upon mounting the beam member 30 thereon, as soon as the locking pin 120 is aligned with a post opening. The latch 100 of the present invention requires no additional labor or consideration for installation of the locking pin in a post opening 22, since the resilient arm 110 biases locking pin 120 into any post opening aligned therewith upon seating the one or more headed lugs into other corresponding post openings, thereby ensuring that the beam member 30 is lockingly connected to the post 20. Additionally, upon assembly of the beam member 30 with the post 20, the locking flange 130 is engageable with the inner side 52 of the beam flange 50, and more particularly the flange recess 57, to prevent withdrawal of the locking pin 120 from the locking pin opening 56, thereby securing the locking pin 120 in the locking pin opening 56, where it is readily biased by the resilient arm into the post opening 22 aligned therewith, and preventing damage to the resilient arm 110 caused by over-flexing.

In the exemplary embodiment of FIGS. 1 and 4, the locking flange 130 includes a tooth 132 protruding therefrom, and the beam flange 50 includes a tooth recess 58 on the inner side 52 thereof generally opposite the tooth 132, and more particularly in the flange recess 57 thereof. The tooth 132 of the locking flange 130 is engageable with the tooth recess 58 of the beam flange 50 as the locking pin 120 is withdrawn through the locking pin opening 56 upon flexing the resilient arm 110 to eliminate or at least substantially reduce the possibility that the locking flange 130 is bent or over-stressed to an extent that permits withdrawal of the locking pin 120 from the locking pin opening 56 by excessive flexing of the resilient arm 110 away from the beam flange 50. The locking flange tooth 132 thereby further secures the locking pin 120 in the locking pin opening 56 of the beam flange 50, where it is readily biased by the resilient arm into the post opening 22 aligned therewith.

In FIG. 1, the tooth 132 extends generally toward the resilient arm 110 and thus toward the tooth recess 58 on the inner side 52 of the beam flange 50. In the exemplary embodiment, the tooth 132 is formed in a stamping operation and thus extends generally toward the locking pin 120. The tooth 132 preferably has a generally triangular shape with a pointed tip 133 as illustrated best in FIG. 4, although in other embodiments the tooth may have other shapes so long as it is engageable with the tooth recess 58 to prevent withdrawal of the locking pin 120 from the locking pin opening 56 of the beam flange 50 and excessive flexing of the resilient arm 110 upon flexing the resilient arm 110 outwardly away therefrom.

FIG. 1 also illustrates the locking flange 130 extending, or angled, slightly toward the resilient arm 110 and thus toward inner side 52 of the beam flange 50, thereby improving engagement of the tooth 132 with the tooth recess 58. The extent, if any, to which the locking flange 130 is angled toward the resilient arm 110 may depend generally on the thickness of the beam flange 30 and the post 20, the size of the tooth 132, the axial length of the locking pin 120 and the alignment thereof, and may be determined by those of ordinary skill in the art without undue experimentation in view of the disclosure herein.

Figure 5:
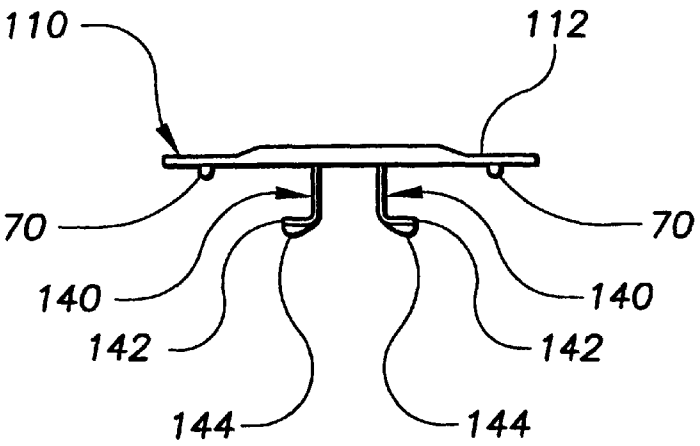
FIG. 5 is a partial end view of a latch according to the present invention.

In FIGS. 1 and 5, the resilient arm 110 has first and second legs 140 protruding from the first end portion 112 thereof. The legs 140 are generally parallel to each other and generally perpendicular to the resilient arm 110. In FIGS. 4 and 5, each leg has a wing member 142 extending outwardly from an end portion thereof, away from the wing member 142 of the other leg and generally parallel to the resilient arm 110. The legs 140 and corresponding wing members 142 form means for fastening the latch 100 to the beam flange 50, as is known generally. Each wing member 142 also has preferably a corresponding angled end portion 144 extending generally away from the resilient arm 110 to facilitate assembly of the latch 100 with the beam flange 50 as discussed further below.

In FIG. 3, the beam flange 50 has generally two openings 150 and 152 therethrough. The openings 150 and 152 are preferably disposed symmetrically about, or on opposing sides of, the novel flange and tooth recesses 57 and 58. Each opening 150 and 152 has an aperture portion 154 located near the flange recess 57 and a slot portion 156 extending away from the flange recess 57. The slot portion 156 of each opening 150 and 152 is formed in a corresponding slot recess 158 formed on the inner side 52 of the beam flange 50.

Generally, one of openings 150 or 152 of the beam flange 50 couples the latch 100 thereto, and the other opening 150 or 152 forms the locking pin opening 56 through which the locking pin 120 is biased to extend by the resilient arm 110, as is known generally. Since the openings 150 and 152 are configured identically, and are arranged symmetrically on the beam flange 50 about the flange recess 57, the latch 100 may be fastened to either opening 150 or 152 and the locking pin 120 may be disposed through either opening 152 or 150.

To fasten the latch 100 to the beam flange 50, the legs 140 are disposed into one of the aperture portions 154 from the outer side 54 of the beam flange 50. The aperture portions 154 are sized to permit passage of the wing members 142 therethrough. The slot portions 156 are sized to accommodate the legs 140 upon sliding the latch 100 relative to the beam flange 50, whereupon the wing members 142 are slidably disposed on corresponding portions of the slot recess 158, illustrated best in FIG. 1. The slot recesses 158 thus accommodate the wing members 142 between the beam flange 50 and the post 20, whereby the inner side 52 of the beam flange 50 may be disposed flushly against the post 20 without interference by the legs 140 or wing members 142. The angled end portions 144 of the wing members 140 facilitate the initial engagement thereof with the slot recess 158.

In FIG. 1, the locking flange 130 is disposed in and through the locking pin opening 56 as the latch is slidably fastened to the beam flange 50. More particularly, as the legs 140 of the latch 100 are slidably disposed along the slot portion 156 of one opening 150 or 152 upon insertion of the locking flange 130 through the aperture portion 154 of the other opening 152 or 150, the locking pin 120 is eventually positioned to pass through the corresponding aperture portion 154 under the bias of the resilient arm 110. The latch 100 is thereby securely coupled to the beam flange 50. Thus assembled, the beam member 30 and latch 100 may be lockingly connected to a post 20, as discussed above.

The symmetrical arrangement of the openings 150 and 152 permits the latch 100 to be assembled with the beam member 30 by coupling the resilient arm 110 thereof to either one of the openings 150 or 152 on the beam flange 50, depending on the intended orientation of the beam member 30 when connected to the post 20. The symmetrical arrangement of the openings 150 and 152 on the beam flange 50 also provides a universal beam flange 50 that may be fastened to either opposing end of a beam member, thereby reducing manufacturing, inventory control and labor costs.

Figure 6:
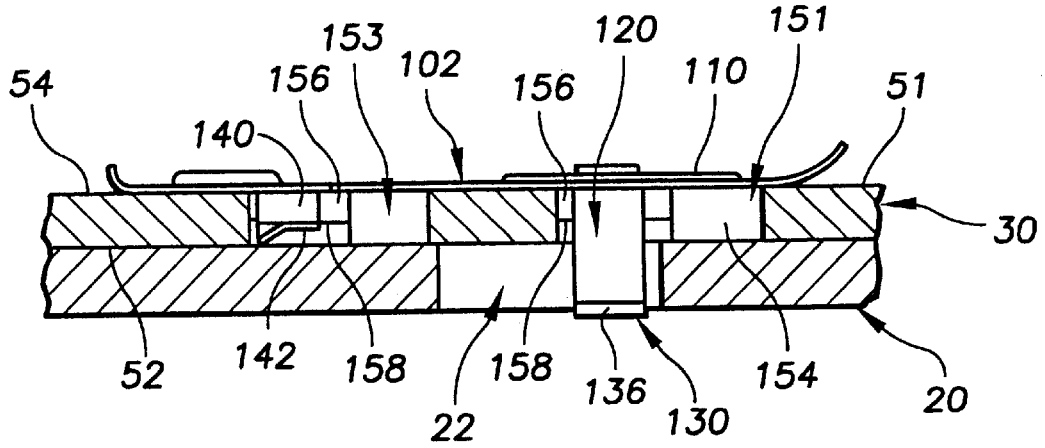
FIG. 6 is a partial sectional view of a storage rack system including a locking latch according to an alternative exemplary embodiment of the present invention.
Figure 7:
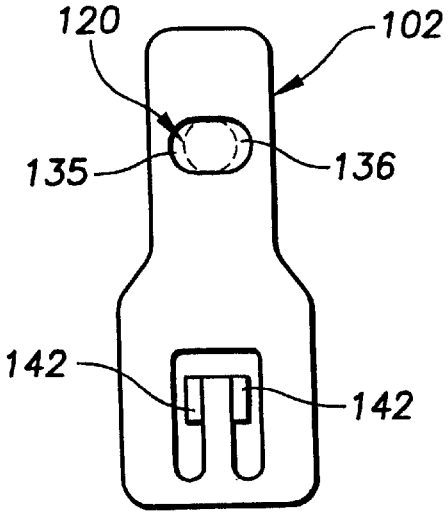
FIG. 7 is a bottom view of the latch in FIG. 6.
Figure 8:
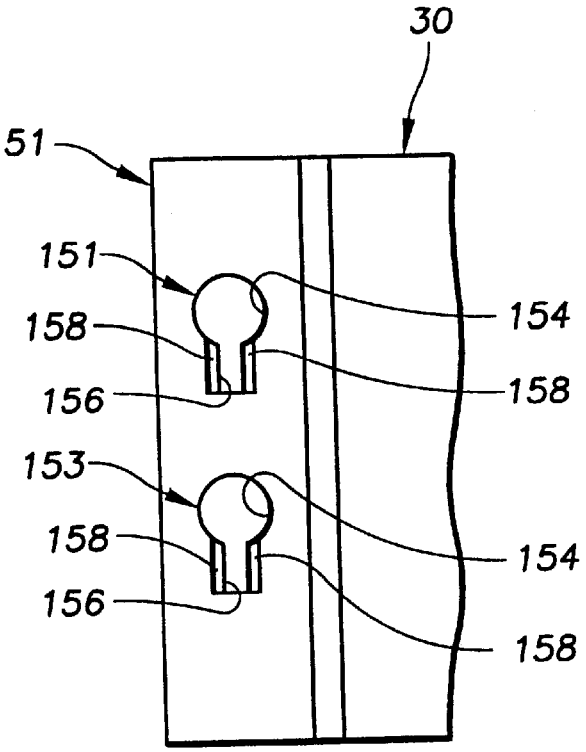
FIG. 8 is a partial view of the beam flange of FIG. 6 on an end of a beam member.

FIGS. 6–8 illustrate an alternative locking latch 102 and alternative beam flange 51, and more particularly an alternative configuration for the locking flange on the locking latch and an alternative configuration for the locking pin openings and flange recess on the beam flange.

In FIG. 8, the beam flange 51 has first and second openings 151 and 153 therethrough. Each opening 151 and 153 has an aperture portion 154 and a slot portion 156 formed in a slot recess 158 on the inner side of the beam flange 51, as discussed generally above. Unlike the embodiment of FIG. 3, however, the openings 151 and 153 in FIG. 8 are disposed asymmetrically on the beam flange 51. More particularly, the slot portion 156 of the first opening 151 is adjacent the aperture portion 154 of the other opening 153. The alternative beam flange 51 is thus asymmetric, and separate right and left handed configurations thereof are required for mounting on opposing end portions of the beam member.

In FIG. 8, the first opening 151 accommodates the locking pin 120, and the slot portion 158 thereof forms the flange recess that accommodates the locking flange, as discussed more fully below. The latch is fastened to the second opening 153, which accommodates the legs and wing members thereof.

In the latch 102 of FIG. 7, the locking flange comprises first and second lobes 135 and 136 extending generally radially from opposing side portions of the locking pin 120. In FIG. 6, during assembly of the beam member 30 with the post 20, the resilient arm 110 is flexed initially away from the outer side 54 of the beam flange 51, as discussed above. The locking flange 130 and more particularly the first and second lobes 135 and 136 thereof are thus disposed in the slot portion 158 of the opening 151 through which the locking pin 120 is disposed when the resilient arm 110 is flexed outwardly to permit insertion of the headed lugs into corresponding post openings. As the beam member 30 is subsequently lowered relative to the post 20 to seat the headed lugs in the corresponding post openings, the locking pin 120 is positioned eventually in alignment with another post opening 22 whereupon the resilient arm 110 biases the locking pin 120 into the post opening 22 aligned therewith to lockingly connect the beam member 30 to the post 20, as discussed above.

To fasten the latch 102 of FIGS. 6 and 7 to the beam flange 51 of FIG. 8, the legs 140 are disposed into the aperture portion 154 of the second opening 153 from the outer side 54 of the beam flange 51, as discussed generally above. And as the legs 140 of the latch 102 are slidably disposed along the slot portion 156 of the opening 153, the locking pin 120 and flange 130 are eventually positioned to pass through the aperture portion 154 of the opening 151 under the bias of the resilient arm 110. Thus assembled, the beam member 30 and latch 102 may be lockingly connected to a post 20, as discussed above.

In FIG. 8, the aperture portion 154 of the opening 151 is sized to accommodate the first and second lobes 135 and 136 of the locking flange so that the locking flange may be disposed through the aperture portion 154. The slot portion 156 of the first opening 151 is also sufficiently wide to accommodate the locking pin 120. The first and second lobes 135 and 136 of the locking flange however will not pass through the slot portion 156 of the opening 151, and are engageable with the slot recess 158 to inhibit withdrawal of the locking pin through the opening 151 upon flexing the resilient arm 110 outwardly away from the beam flange 51. The slot recess 158 of the opening 151 thus forms the locking flange recess, and is sufficiently deep to prevent the locking pin 120 from protruding so far beyond the inner side 52 of the beam flange 51 as to prevent assembly of the beam member 30 with the post 20.

In other embodiments, the exemplary latches 100 and 102 may be coupled to the beam member 30 and more particularly to the beam flange by other means, for example as disclosed in the referenced U.S. Pat. No. 3,905,712 entitled "Snap Lock For Quickly-Detachable Beam-To-Post Joint". In these alternative embodiments, the beam flange includes a locking pin opening and a latch recess for accommodating the locking flange during assembly of the latch with the beam flange and for accommodating the locking pin under the bias of the resilient arm, as discussed above.

In FIG. 1, the latch 100 includes an assembly aperture 101 therethrough, illustrated in phantom lines in FIG. 4, aligned with an opening through the beam flange 50 when the latch 100 is assembled therewith to facilitate handling of the beam member 30 during fabrication thereof. In the exemplary embodiment of FIG. 1, the assembly aperture 101 is aligned with the opening of the beam flange to which the legs of the latch 100 are fastened as discussed above. The alternative latch 102 of FIGS. 6–8 may include a similar aperture. In other embodiments illustrated in FIG. 2, the latch 100 does not include the assembly aperture 101, whereby a portion 103 of the resilient arm 110 largely covers the aperture portion 154 of the opening, as illustrated best in FIG. 1.

In some manufacturing operations, the handling capability afforded by the assembly aperture 101 permits fastening the latch 100 to the beam flange 50 immediately after welding the beam flange to the beam member by the same laborer performing the welding operation, thereby eliminating additional labor specifically dedicated to fastening the latch to the beam flange at some other manufacturing stage. The assembly aperture 101 permits, for example, suspending the beam flange 50 and latch 100 with a hook disposed through the opening 101 of the latch and through the opening of the beam flange aligned therewith during handling, rinsing and painting operations.

In FIGS. 4 and 5, the latch 100 includes, alternatively and preferably, aplurality of protrusions 70, for example in the form of dimples, extending from the resilient arm 110 on the same side thereof as the locking pin 120. The protrusions 70 form a small space or gap between the latch 100 and the beam flange 50 when the latch is fastened thereto to permit rinsing or the elimination of oil and residue therebetween. In some assembly operations, for example, the latch 100 may be mounted on the beam flange 50 at an early manufacturing stage, whereupon the beam flange and latch assembled thereto are subsequently subject to a rinsing operation to remove grease or oil. The protrusions 70 and the gap formed thereby facilitate the removal of grease and debris from between the latch 100 and the beam flange 50, and also facilitate the application of coatings, for example paint, therebetween in subsequent coating operations. The extent to which the protrusions 70 extend from the latch 100 depends on the gap, or clearance, desired between the latch and the beam flange upon assembly thereof, and may be determined readily by those of ordinary skill in the art without undue experimentation in view of the disclosure herein. The alternative latch embodiment 102 of FIGS. 6–7 may also include protrusions thereon.

The locking latches of the present invention may be formed as an assembly of components, for example metals fabricated in one or more metal forming operations. Alternatively, the latch may be formed unitarily and from materials other than metals, for example from molded glass filled plastic materials.

The resilient arm including the legs and the wing members thereof may be formed, for example, from sheet metal stock in a stamping or other known forming operations. The locking pin may be formed from cylindrical stock. In one embodiment, a reduced radius is formed on an end portion of the locking pin in a cold heading operation. The reduced radius of the locking pin is disposed through a corresponding opening in the resilient arm, and then fastened thereto upon deformation of the locking pin, for example by a cold staking operation or by an orbital riveting operation. Alternatively, the locking pin may be fastened to the resilient arm by a spring clip disposed about the reduce radius thereof. Other fastening means may also be used to assemble the locking pin with the resilient arm, including welding.

The locking flange including any tooth thereof may be formed of sheet metal stock in known forming operations, and then fastened to the locking pin. In one embodiment, a reduced radius is formed on an end portion of the locking pin, and the reduced radius is disposed in a corresponding opening formed in the locking flange. The locking pin is then fastened to the locking flange upon deformation thereof, for example by a cold staking operation or by an orbital riveting operation. Alternatively, the locking pin may be fastened to the locking flange by a spring clip disposed about the reduce radius thereof. Other fastening means may also be used to assemble the locking pin with the locking flange, including welding. Alternatively, the locking flange may be formed unitarily with the locking pin, for example in a cold heading or casting or in some other forming operation. This latter alternative may be particularly suitable for formation of a locking pin and locking flange having first and second lobes, as illustrated in FIGS. 6 and 7.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A storage rack system comprising:

a post having a plurality of openings;

a beam member having a beam flange with an inner side and an outer side, a headed lug protruding from the inner side of the beam flange, the headed lug disposable in a corresponding opening of the post to connect the beam member to the post;

a locking pin opening in the beam flange, the locking pin opening aligned at least partially with one of the plurality of openings of the post when the beam member is connected to the post;

a flange recess on the inner side of the beam flange;

a latch coupled to the beam flange, the latch having a resilient arm on the outer side of the beam flange with a locking pin extending therefrom, the resilient arm biasing the locking pin to protrude through the locking pin opening of the beam flange and at least partially into an opening of the post aligned with the locking pin opening when the beam member is connected to the post;

a locking flange extending generally radially from the locking pin, the locking flange being adjacent the flange recess, and the locking flange being engageable with the flange recess to limit flexing of the resilient arm as the locking pin is withdrawn from the locking pin opening, wherein the locking flange is a lobe extending from a side of the locking pin; and a tooth protruding from the locking flange and extending toward the resilient arm, the beam flange having a tooth recess disposed in the flange recess, and the tooth being engageable with the tooth recess as the locking pin is withdrawn from the locking pin opening.

2. The system of claim 1, the locking flange is angled toward the resilient arm.

3. The system of claim 1, the beam flange having first and second openings, one of the first and second openings is the locking pin opening.

4. The system of claim 3, the latch having an assembly aperture therethrough and aligned at least partially with one of the first and second openings.

5. A storage rack system comprising:

a post having a plurality of openings;

a beam member having a beam flange with an inner side and an outer side, a headed lug protruding from the inner side of the beam flange, the headed lug disposable in a corresponding opening of the post to connect the beam member to the post;

a locking pin opening in the beam flange, the locking pin opening aligned at least partially with one of the plurality of openings of the post when the beam member is connected to the post;

a flange recess on the inner side of the beam flange:

a latch coupled to the beam flange, the latch having protrusions extending from a side thereof adjacent the beam flange to form a gap between the latch and the beam flange, the latch having a resilient arm on the outer side of the beam flange with a locking pin extending therefrom, the resilient arm biasing the locking pin to protrude through the locking pin opening of the beam flange and at least partially into an opening of the post aligned with the locking pin opening when the beam member is connected to the post; and a locking flange extending generally radially from the locking pin, the locking flange adjacent the flange recess, and the locking flange being engageable with the flange recess to limit flexing of the resilient arm as the locking pin is withdrawn from the locking pin opening.

6. A storage rack system comprising:

a post having a plurality of openings;

a beam member having a beam flange with an inner side and an outer side, a headed lug protruding from the inner side of the beam flange, the headed lug disposable in a corresponding opening of the post to connect the beam member to the post;

a locking pin opening in the beam flange, the locking pin opening aligned at least partially with one of the plurality of openings of the post when the beam member is connected to the post;

a flange recess on the inner side of the beam flange;

a latch coupled to the beam flange, the latch having a resilient arm on the outer side of the beam flange with a locking pin extending therefrom the resilient arm biasing the locking pin to protrude through the locking pin opening of the beam flange and at least partially into an opening of the post aligned with the locking pin opening when the beam member is connected to the post, wherein the locking pin has an end portion extending away from the resilient arm; and a locking flange extending from the end portion of the locking pin, the locking flange including first and second lobes extending generally radially from opposing sides of the locking pin, the lobes being adjacent the flange recess, and the lobes being engageable with the flange recess to limit flexing of the resilient arm as the locking pin is withdrawn from the locking pin opening.

7. The system of claim 6, the beam flange having first and second openings disposed thereon, each opening of the beam flange has an aperture portion and a slot portion, the slot portion is formed in a slot recess formed on the inner side of the beam flange, the slot portion of one opening is adjacent the aperture portion of the other opening, one of the openings is the locking pin opening and the slot recess thereof is the flange recess.

8. A storage rack system comprising:

a post having a plurality of openings;

a beam member having a beam flange with an inner side, an outer side, and first and second openings disposed symmetrically thereon, a headed lug protruding from the inner side of the beam flange, the headed lug including a lug flange extending generally radially from a side portion thereof, the headed lug disposable in a corresponding opening of the post to connect the beam member to the post;

a locking pin opening in the beam flange, the locking pin opening aligned at least partially with one of the plurality of openings of the post when the beam member is connected to the post, the locking pin opening being one of the first and second openings of the beam flange;

a flange recess on the inner side of the beam flange, the flange recess being disposed between the first and second openings of the beam flange;

a latch coupled to the beam flange, the latch having a resilient arm on the outer side of the beam flange with a locking pin extending therefrom, the resilient arm biasing the locking pin to protrude through the locking pin opening of the beam flange and at least partially into an opening of the post aligned with the locking pin opening when the beam member is connected to the post; and a locking flange extending from an end portion of the locking pin, the locking flange being a lobe that extends from one side of the locking pin, the locking flange being adjacent the flange recess, the locking flange extending generally in the same direction as the lug flange, and the locking flange being engageable with the flange recess to limit flexing of the resilient arm as the locking pin is withdrawn from the locking pin opening.

9. The system of claim 8, each opening of the beam flange has an aperture portion located near the flange recess and a slot portion extending away from the flange recess, the slot portion is formed in a slot recess on the inner side of the beam flange.

10. The system of claim 9 further comprising a tooth protruding from the locking flange and extending toward the resilient arm, the locking flange is angled toward the resilient arm, and a tooth recess disposed in the flange recess.

11. The system of claim 9, the resilient arm has a first end portion with first and second legs protruding therefrom, each leg has a wing member extending outwardly away from the wing member of the other leg, the legs of the resilient arm are slidable into the slot portion of one of the openings and the wing members are disposed in the slot recess thereof to fasten the latch to the beam member.

12. A flex-limited latch for locking a beam member connected to a post with a headed lug, the latch comprising:

a resilient arm;

a locking pin extending from a side of the resilient arm;

a locking flange extending from the locking pin generally parallel to the resilient arm; and a tooth protruding from the locking flange toward the resilient arm, the tooth extending toward the locking pin.

13. The latch of claim 12, the locking flange is angled toward the resilient arm.

14. The latch of claim 12, a beam flange engagement member disposed on the resilient arm, the locking pin spaced apart from the beam flange engagement member.

15. A flex-limited latching locking latch and beam member combination connectable to a post with a headed lug, the combination comprising:

a beam flange on the beam member, the beam flange having opposite sides and a locking pin opening;

a resilient arm having a portion thereof coupled to one side of the beam flange;

a locking pin extending from the resilient arm, the locking pin protruding through the locking pin opening;

a locking flange extending generally radially from the locking pin, the locking flange spaced apart from the resilient arm;

a flange recess disposed on the side of the beam flange opposite the side thereof to which the resilient arm is coupled, the recess disposed at least partially about a portion of the locking pin opening, portions of the locking flange being disposed in the flange recess; and wherein the locking flange is generally disk shaped, the locking pin opening has a first portion through which the locking flange may be disposed from the side of the beam flange to which the resilient arm is coupled, the locking pin opening having a slot portion extending from the first portion through which the locking pin extends, and the flange recess is formed adjacent opposite sides of the slot portion of the locking pin opening.

16. The combination of claim 15, the locking flange protruding radially from an end portion of the locking pin, the locking flange not protruding beyond the side of the beam flange opposite the side thereof the which the resilient arm is coupled.

17. The combination of claim 16, the locking flange protruding radially from an end portion of the locking pin, the locking pin and the locking flange not protruding beyond the side of the beam flange opposite the side thereof to which the resilient arm is coupled when the locking flange is disposed in the flange recess.

18. A flex-limited latching locking latch and beam flange combination, comprising:

a locking pin opening through the beam flange;

a resilient arm having a portion thereof coupled to one side of the beam flange;

a locking pin extending from the resilient arm, the locking pin protruding through the locking pin opening;

a locking flange extending generally radially from the locking pin, the locking flange disposed on a side of the beam flange opposite the side on which the resilient arm is disposed;

a flange recess disposed on the same side of the beam flange as the locking flange, the flange recess disposed at least partially about the locking pin opening; and wherein the locking flange is disposable in the flange recess when the resilient arm is flexed away from the beam flange, the locking flange and the locking pin do not protrude beyond the side of the beam flange in which the flange recess is disposed when the locking flange is disposed in the flange recess, the locking flange is generally disk shaped, the locking pin opening has a first portion through which the locking flange may be disposed from the side of the beam flange to which the resilient arm is coupled, the locking pin opening having a slot portion extending from the first portion thereof, and the flange recess being formed adjacent opposite sides of the slot portion of the locking pin opening.

19. A flex-limited latching locking latch and a beam member having a headed lug which is adapted to be received by a first opening in a post so as to connect the beam member to the post the combination comprising:

a beam flange having a first opening for receiving the headed lug, a spaced apart second opening, and a recess; and a latch assembly including a resilient arm having a portion that is homogeneously formed therewith and that is received by a mating portion in the beam flange to securely couple the resilient arm to a side of said beam flange, and such that the resilient arm biases the locking pin through the second opening of the beam flange and at least partially into a second opening of the post aligned with the second opening of the beam flange when the beam member is connected to the post, and such that when the locking pin is withdrawn from the opening in the post to allow the beam member to be disconnected from the post, the recess in the beam flange prevents the locking pin from being completely withdrawn from the second opening of the beam flange by limiting the movement of the resilient arm.

20. The combination as set forth in claim 19, wherein the recess in the beam flange is found on a side of the beam flange that is opposite to the side of the beam flange to which the resilient arm is disposed.

21. The combination as set forth in claims 19 wherein the locking pin includes a flex limiting member which is adapted to be received by the recess in the beam flange when the locking pin is retracted from the second opening in the beam flange, thereby preventing the locking pin from being completely withdrawn from the second opening of the beam flange, while at the same time limiting the movement of the resilient arm.

22. The combination as set forth in claim 21, wherein the locking pin and the flex limiting member do not protrude beyond the side of the beam flange in which the recess in the beam flange is disposed when the flex limiting member is disposed in the recess in the beam flange.

* * * * *

UNITED STATES PATENT AND TRADEMARK OFFICE

CERTIFICATE OF CORRECTION

PATENT NO. : 6,443,320 B1
DATED : September 3, 2002
INVENTOR(S) : Herzog et al.

It is certified that error appears in the above-identified patent and that said Letters Patent is hereby corrected as shown below:

Column 14,
Line 18, after "post", insert -- , --.
Line 28, before "such that", insert -- a locking pin extending from the resilient arm, --.

Signed and Sealed this

Fourth Day of February, 2003

JAMES E. ROGAN
*Director of the United States Patent and Trademark Office*